US008261669B2

(12) United States Patent
Grundlingh

(10) Patent No.: US 8,261,669 B2
(45) Date of Patent: Sep. 11, 2012

(54) CONVEYANCE DEVICE

(76) Inventor: Llewellyn John Grundlingh, Midrand (ZA)

( * ) Notice: Subject to any disclaimer, the term of this patent is extended or adjusted under 35 U.S.C. 154(b) by 522 days.

(21) Appl. No.: 12/083,437

(22) PCT Filed: Oct. 10, 2006

(86) PCT No.: PCT/IB2006/053715

§ 371 (c)(1),
(2), (4) Date: Aug. 11, 2009

(87) PCT Pub. No.: WO2007/043008

PCT Pub. Date: Apr. 19, 2007

(65) Prior Publication Data

US 2009/0293753 A1 Dec. 3, 2009

(30) Foreign Application Priority Data

Oct. 12, 2005 (ZA) ..... 2005/08241

(51) Int. Cl.
*B61B 13/10* (2006.01)

(52) U.S. Cl. ..... 104/138.2; 105/365

(58) Field of Classification Search ..... 104/138.1, 104/138.2; 105/365; 254/134.6
See application file for complete search history.

(56) References Cited

U.S. PATENT DOCUMENTS

| | | | |
|---|---|---|---|
| 4,522,129 A | 6/1985 | Jerberyd | |
| 5,080,020 A | 1/1992 | Negishi | |
| 6,672,673 B1 * | 1/2004 | Miller et al. | 299/10 |

FOREIGN PATENT DOCUMENTS

| | | |
|---|---|---|
| DE | 100 01 334 | 7/2001 |
| FR | 2 647 527 | 11/1990 |

OTHER PUBLICATIONS

International Search Report for PCT/IB2006/053715 dated May 7, 2007.

International Preliminary Report on Patentability for PCT/IB2006/053715, mailed Jan. 16, 2008.

* cited by examiner

*Primary Examiner* — S. Joseph Morano
*Assistant Examiner* — Zachary Kuhfuss
(74) *Attorney, Agent, or Firm* — Nixon & Vanderhye PC

(57) ABSTRACT

The invention provides a conveyance device, suitable for traveling along a surface and conveying an explosive charge, the conveyance device including a propulsion member having two opposite ends, the propulsion member being displaceable between a longitudinally extended position wherein the ends are displaced away from one another; and a longitudinally contracted position wherein the ends are displaced toward one another; an outer gripping member and an inner gripping member, each gripping member being displaceable between a circumferentially expanded position wherein an outer perimeter of the gripping member is displaced away from a center of the member so as to, in use, abut at least part of the surface; and a circumferentially contracted position wherein an outer perimeter of the gripping member is displaced towards the center of the member so as to be spaced apart from the surface; the propulsion member and the gripping members being configured in order for sequential displacement of the propulsion member and gripping members to result in peristaltic displacement of the conveyance device relative to the surface.

21 Claims, 3 Drawing Sheets

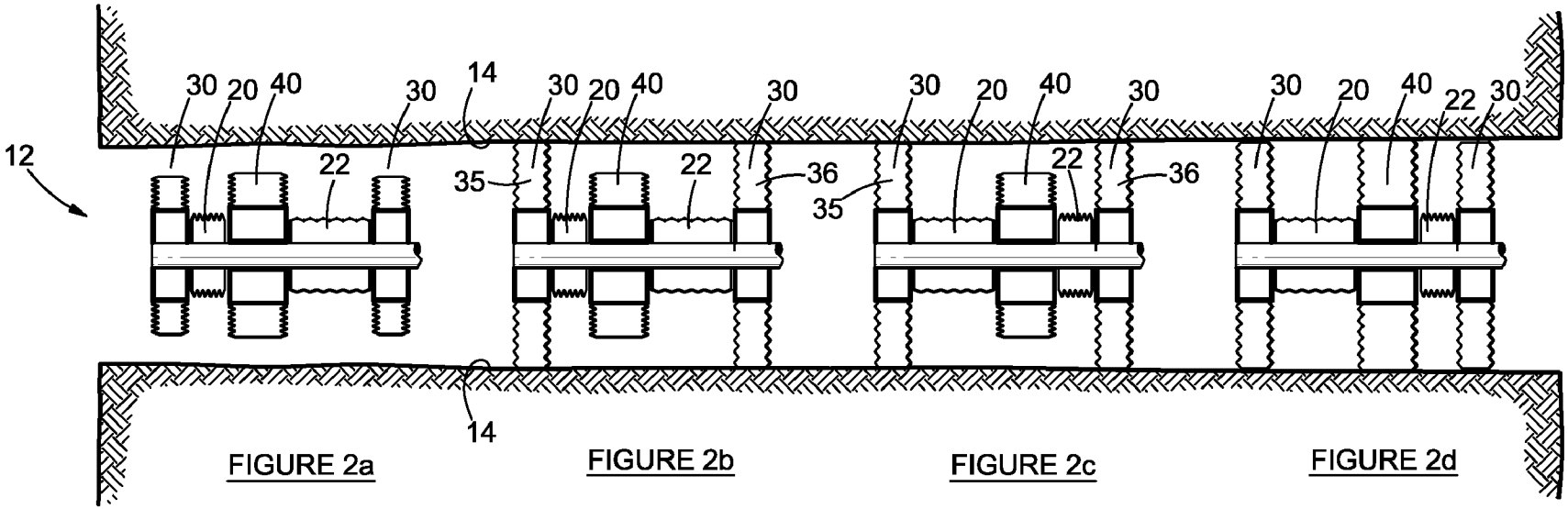
FIGURE 2a
FIGURE 2b
FIGURE 2c
FIGURE 2d
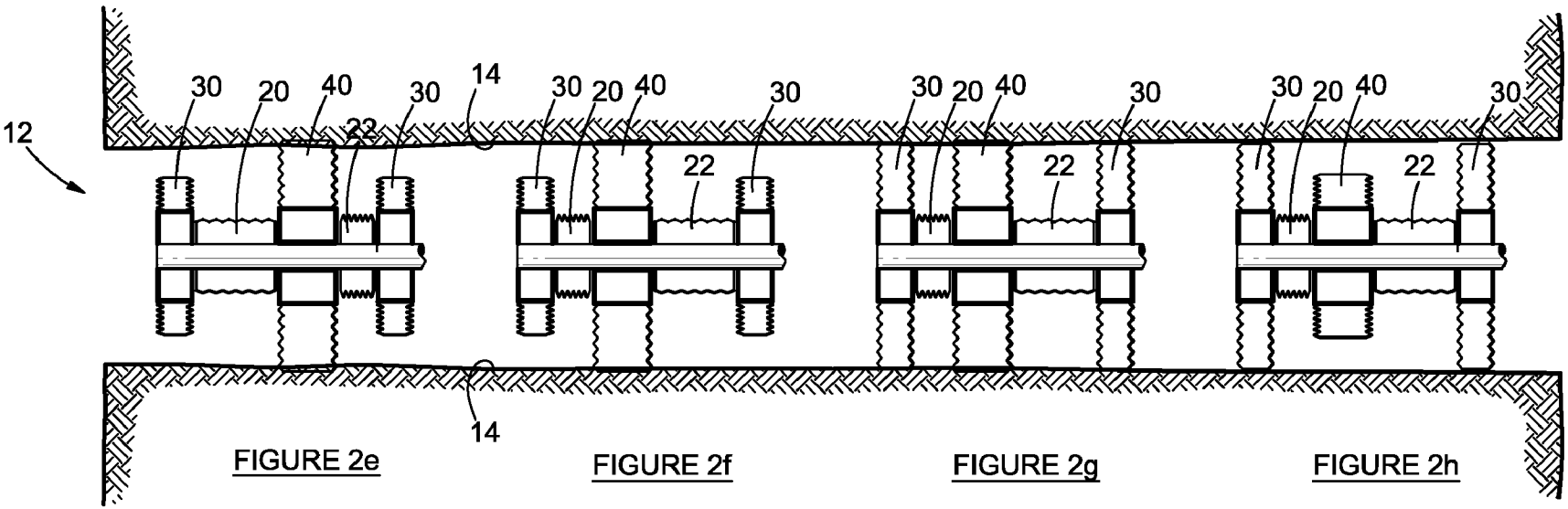
FIGURE 2e
FIGURE 2f
FIGURE 2g
FIGURE 2h

CONVEYANCE DEVICE

This application is the U.S. national phase of International Application No. PCT/IB2006/053715 filed 10 Oct. 2006 which designated the U.S. and claims priority to South African Application No. 2005/08241 filed 12 Oct. 2005, the entire contents of each of which are hereby incorporated by reference.

FIELD OF THE INVENTION

The invention relates to a conveyance device, and more particularly, but not exclusively to a peristaltic conveyance device suitable for traveling inside an elongate passage whilst conveying an explosive charge.

BACKGROUND TO THE INVENTION

The need often arises to transport an object inside or along an elongate passage that is unsuitable for human entrance due to size constraints or safety concerns. This situation for instance occurs in the mining environment when ore passes become obstructed.

An ore pass is a passage drilled between parallel upper and lower tunnels in a mine. In use ore is deposited into the upper end of the ore pass that extends downwardly from the bottom wall of the upper tunnel. The lower end of the ore pass, extending upwardly from the top wall of the bottom tunnel, is closed by means of a steel door, thus causing the ore to accumulate inside the ore pass. When required, the door is opened so as to deposit the ore in the ore pass into trucks located below the lower opening of the ore pass. This configuration serves to effectively remove ore in an environment where space is of utmost concern, as it will be difficult, if not impossible, to load ore into a truck located in the same tunnel as the ore.

The abovementioned method works well, but from time to time an ore pass tends to block due to ore becoming stuck therein. Due to the nature of these blockages the ore pass is usually opened by blasting the ore pass open using an explosive charge, thus dislodging the obstructing ore.

A number of methods have previously been utilized to load the explosive charge into the ore pass. In one example a person climbs into the ore pass and pushes the explosive charges towards the blockage using a specially designed cart. A further option is to shoot the explosive charge into the ore pass using a compressed air catapult device. In both cases the explosive charge is then detonated once the personnel involved in the operation have been evacuated. However, in both cases substantial manual intervention is required, and the method is also not as controlled as is desirable when working with explosives. These methods have therefore been declared unsafe mining practices by safety authorities.

A safer option is to utilize radio controlled vehicles to convey the explosive charge into the ore pass. However, ore passes are often orientated at steep inclinations, thus rendering the use of these radio controlled devices impractical due to loss of traction at acute angles.

Due to the lack of cost-efficient yet safe solutions to this problem, the preferred option is often to leave the ore pass in the blocked condition, and to drill a new ore pass adjacent the blocked ore pass. It will be appreciated that valuable ore is lost in this manner, and that considerable expenses are incurred in drilling new ore passes.

OBJECT OF THE INVENTION

It is accordingly an object of this invention to provide a conveyance device that will, at least partially, alleviate the disadvantages mentioned above, and/or will provide a useful alternative to existing conveyance devices used for similar applications.

SUMMARY OF THE INVENTION

A conveyance device, suitable for traveling along a surface and conveying an explosive charge, the conveyance device including:

a propulsion member having two opposite ends, the propulsion member being displaceable between
- a longitudinally extended position wherein the ends are displaced away from one another; and
- a longitudinally contracted position wherein the ends are displaced towards one another;

an outer gripping member and an inner gripping member, each gripping member being displaceable between
- a circumferentially expanded position wherein an outer perimeter of the gripping member is displaced away from a center of the member so as to, in use, abut at least part of the surface; and
- a circumferentially contracted position wherein an outer perimeter of the gripping member is displaced towards the center of the member so as to be spaced apart from the surface;

at least one end of the propulsion member abutting at least one of the gripping members, and the propulsion member and the gripping members being configured in order for sequential displacement of the propulsion member and gripping members to result in peristaltic displacement of the conveyance device relative to the surface.

Preferably the propulsion member is sandwiched between the two gripping members in order for the ends of the propulsion member to at least partially abut the gripping members.

There is provided for the ends of the propulsion member to be connected to the gripping members, and alternatively for the ends of the propulsion members only to abut the gripping members.

In a preferred embodiment the conveyance device may include two propulsion members located on opposite sides of the inner gripping member, with two outer gripping members located at free ends of the propulsion members.

The two outer gripping members may be stationary relative to one another, and the inner gripping member may be displaceable between the two outer gripping members. Preferably the outer gripping members may be connected to one another by way of an elongate connecting member, and the inner gripping member may be slideably located on the elongate connecting member.

The elongate connecting member may be in the form of a circular shaft or rod, and the inner gripping member may be mounted on a sleeve adapted to slide on the shaft or rod.

Preferably the outer gripping members form a pair of outer gripping members operating in concert so that both outer gripping members are simultaneously in the circumferentially expanded or contracted positions. Preferably the two propulsion members are configured to operate in an inverse relationship, with one propulsion member being in an extended position when the other is in a contracted position.

There is provided for the gripping members to be in the form of circumferentially displaceable bellows, and alternatively for the gripping members to be in the form of circumferentially expandable air cushions or bladders. Preferably the gripping members are pneumatically operated.

There is also provided for the propulsion members to be in the form of longitudinally extendable bellows, and alternatively for the propulsion members to be in the form of longitudinal extendable air cushions or bladders. Preferably the propulsion members are pneumatically operated.

The conveyance device further includes a control system adapted to regulate a pneumatic fluid in order to selectively displace the gripping members and the propulsion members so as to achieve peristaltic movement of the conveyance device.

In a further embodiment of the invention the conveyance device may include an auxiliary gripping member, the auxiliary gripping member being located outside one of the outer gripping members, and being detachable from the conveyance device so as to remain behind when the conveyance device is returned to its original position.

The auxiliary gripping member may be adapted to hold an object.

The object may be an explosive charge, and the surface along which the conveyance device is conveyed may be an elongate passage in the form of an ore pass.

According to a further aspect of the invention there is provided a method of operating a conveyance device of the type described hereinbefore, the method including the steps of:

displacing the outer gripping member to the expanded position, while maintaining the inner gripping member and the propulsion member in contracted positions; and displacing the propulsion member to the extended position so as to move the inner gripping member away from the outer gripping member.

The inner gripping member may subsequently be displaced to the expanded position, and the outer gripping member to the contracted position, so as to allow the outer gripping member to be displaced towards the inner gripping member when the propulsion member is displaced to the contracted position.

The method also include the further steps of:

displacing the outer gripping member to the expanded position; and displacing the inner gripping member to the contracted position so as to return the conveyance device to an initial state wherein a next operating cycle can commence.

In a preferred embodiment, in which the conveyance device includes two outer gripping members and two propulsion devices, the outer gripping members may be displaced in concert. In this embodiment the method may include the step of simultaneously displacing one propulsion member to the contracted position when the other propulsion member is displaced towards the extended position.

The propulsion and gripping members are preferably displaced by regulating the flow of a pneumatic fluid into and out of the propulsion and gripping members.

In accordance with a further aspect of the invention there is provided a method of locating an explosive charge inside an elongate passage including the steps of:

providing a conveyance device as described hereinbefore;

positioning an explosive charge at an end of the conveyance device;

locating the conveyance device inside an ore pass; and causing the conveyance device to advance inside the ore pass in accordance with the method of operating a conveyance device as described hereinbefore.

The method may further include the steps of:

locating the explosive charge on an auxiliary gripping member located at an end of the conveyance device;

displacing the auxiliary gripping device to an expanded position once a selected location inside the ore pass is reached; and detaching the auxiliary gripping device form the rest of the conveyance device so that the conveyance device can be removed while the auxiliary gripping device, and the charge carried thereby, remain in the ore pass.

BRIEF DESCRIPTION OF THE DRAWINGS

One embodiment of the invention is described by way of a non-limiting example, and with reference to the accompanying drawings in which:

FIGS. 2*a* to 2*h* schematically show the sequential operation of the conveyance device inside an ore pass causing the device to travel along the ore pass.

DETAILED DESCRIPTION OF THE INVENTION

Figure 1:
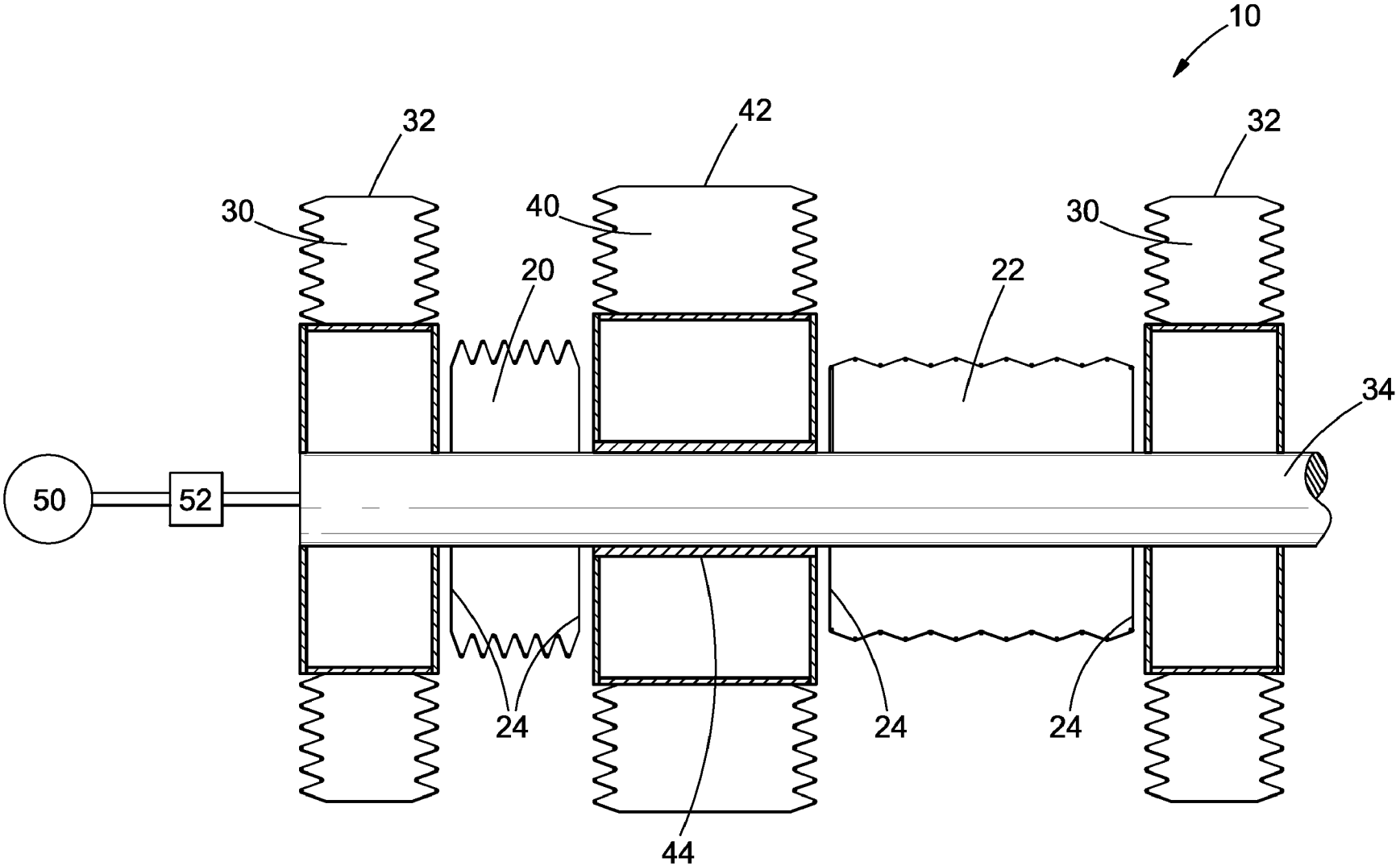
FIG. 1 is a cross sectional side view of the conveyance device in accordance with the invention.

Referring to the drawings, in which like numerals indicate like features, a non-limiting example of a conveyance device in accordance with the invention is indicated by reference numeral 10.

The conveyance device 10, which is adapted to travel along a surface, and more particularly an ore pass, includes two outer gripping members 30 being stationary relative to one another, and an inner gripping member 40 located intermediate the two outer gripping members 30 and being moveable relative to the outer gripping members 30. The two outer gripping members 30 are connected to one another by means on an elongate connecting means 34 in the form of a pipe, a rigid rod or a shaft. The inner gripping member 40 is located on a sleeve 44, which is slideably mounted on the connecting means 34 in order for the inner gripping member 40 to be slideably displaceable relative to the two outer gripping members 30.

Each gripping member, 30 or 40, is displaceable between a circumferentially expanded position wherein an outer perimeter, 32 or 42, of the gripping member is displaced away from a center of the member so as to, in use, increase a maximum span of the gripping member so as to cause it to abut at least part of the surface on which it is used, and a circumferentially contracted position wherein an outer perimeter, 32 or 42, of the gripping member is displaced towards the center of the member, 30 or 40, so as decrease a maximum span of the gripping member resulting in the gripping member being spaced apart from the surface on which it is used. In this embodiment the gripping members are in the form of pneumatically operated bellows or compensators. However, the inventor foresees that many different devices may be used, including pneumatic or hydraulic bladders or air cushions.

The conveyance device 10 also includes two propulsion members, 20 and 22, for in use propelling the conveyance device to move along the surface on which it is used. Each propulsion device, 20 or 22, has opposite ends 24, and is displaceable between a longitudinally extended position wherein the ends are displaced away from one another and a longitudinally contracted position wherein the ends are displaced towards one another. The ends 24 of the propulsion members, 20 and 22, are adapted selectively to abut the inner 40 and outer 30 gripping members when the propulsion members, 20 and 22, are displaced towards the longitudinally extended positions. The propulsion members, 20 and 22, are moveable relative to the elongate connecting means 34 extending between the two outer gripping members 30. In this embodiment the propulsion members are in the form of pneumatically operated bellows or compensators. However, the inventor foresees that many different devices may be used, including pneumatic or hydraulic bladders or air cushions.

The conveyance device 10 is in flow communication with a compressed air source 50, and a control system 52 regulates the flow of compressed air into and out of the various gripping and propulsion members, so as to cause the peristaltic movement as described in more detail hereinbelow.

An operational cycle of the conveyance device 10 is depicted in FIGS. 2*a* to 2*h*. In FIG. 2*a* the conveyance device is in an inoperative condition, with the inner gripping member 40, as well as the outer gripping members 30, being a first outer gripping member 35 and a second outer gripping member 36, in contracted positions. The first 35 and the second 36 outer gripping members 30 function as a pair, and are in the same positions throughout the operating cycle of the conveyance device 10. The first propulsion member 20 is in a contracted position, whist the second propulsion member 22 is in an extended position. The conveyance device 10 can now be loaded into an elongate passage 12 in which it is to be used, in this case being an ore pass. The contracted positions of the gripping members allow the conveyance device to be inserted into the ore pass 12 without fully abutting the walls 14 of the ore pass 12. The conveyance device 10 is connected to the compressed air supply (not shown) via a control system (not shown), the control system being adapted to regulate the airflow into the gripping and propulsion members so as to achieve the peristaltic movement as described below.

In FIG. 2*b* the outer gripping members 30, are displaced to the circumferentially expanded positions in order for perimeters 32 thereof to abut the walls 14 of the ore pass 12, thus securing the conveyance device 10 inside the ore pass 12. The first propulsion member 20 is now displaced to the extended position, whilst the second propulsion member 22 is displaced to the contracted position, in so doing urging the inner gripping member 40 to move from the first outer gripping member 35 towards the second outer gripping member 36, as shown in FIG. 2*c*. In FIG. 2*d* the inner gripping member 40 is displaced to the expanded position in order for a perimeter 42 thereof to abut the wall 14 of the ore pass 12. The outer gripping members 30 can now be displaced towards the contracted positions, as the conveyance device 10 is now kept in position by the inner gripping member 40. Once the outer gripping members 30 have been contracted, as shown in FIG. 2*e*, the first propulsion member 20 is displaced to the contracted position while the second propulsion member 22 is displaced to the extended position. This causes the outer gripping members 30 to be displaced relative to the inner gripping member 40, which in this phase remains stationary relative to the wall 14 of the ore pass 12 as shown in FIG. 2*f*. When the outer gripping members 30 have been sideways displaced relative to the inner gripping member 40, the outer gripping members are displaced to the expanded position shown in FIG. 2*g*. The inner gripping member 40 is now displaced to the contracted position, as the outer gripping members 30 now hold the conveyance device 10 in position in the ore pass 12. The conveyance device 10 has thus traveled along the ore pass 12 for a distance equaling the stroke of the propulsion devices 20 and 22, and the sequence can be repeated. In this way, by sequential displacement of the various gripping and propulsion members, the conveyance device travels along the ore pass by way of a series of peristaltic expansions and contractions.

Figure 3:
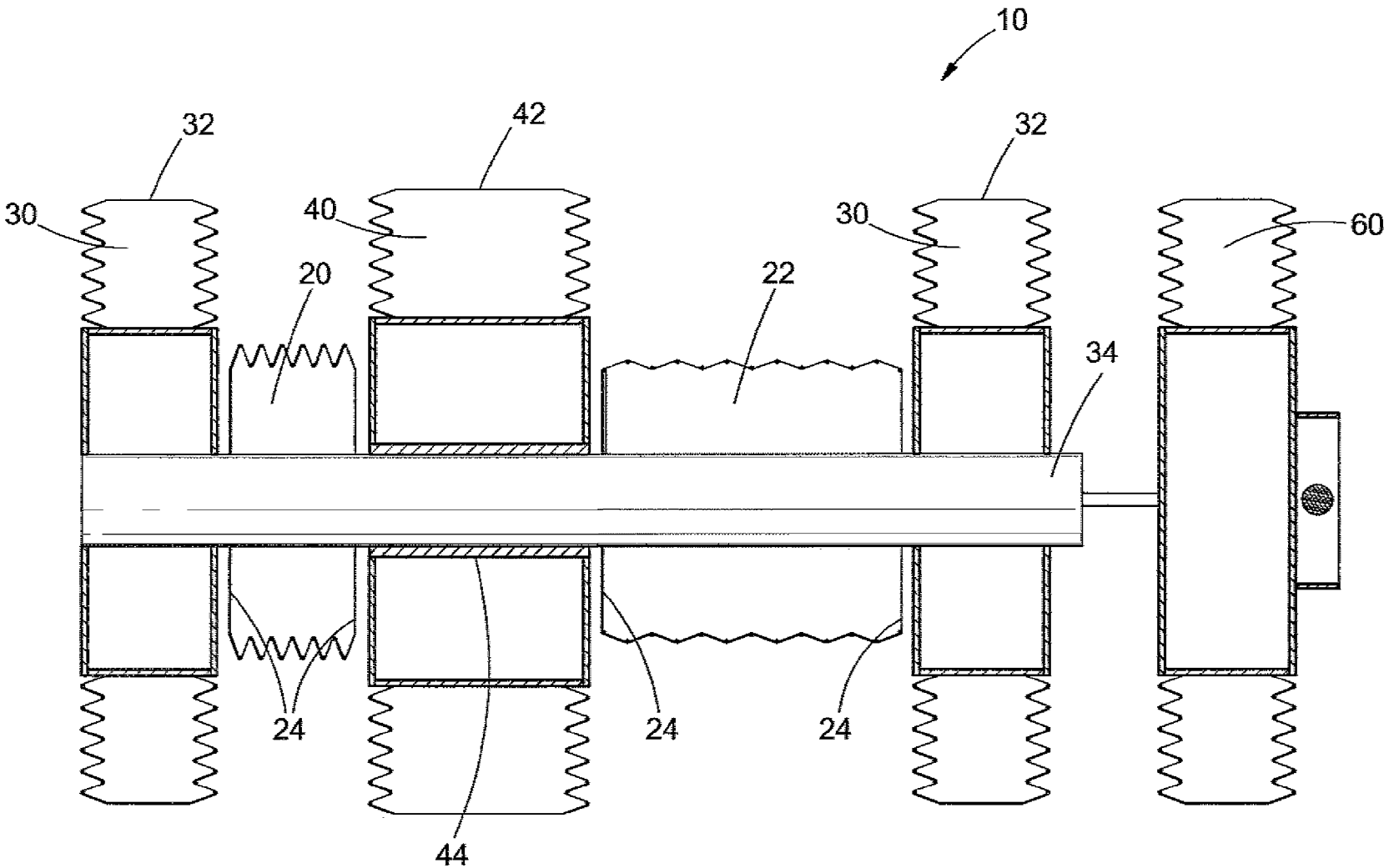
FIG. 3 is a cross sectional side view of the conveyance device of FIG. 1 including an auxiliary gripping member for carrying and locating an explosive charge.

As shown in FIG. 3, the conveyance device 10 may also include an auxiliary gripping device 60. The auxiliary gripping device 60 is removably connected to one end of the conveyance device 10, and is adapted to securely hold an explosive charge. When a particular location is reached, the auxiliary gripping member 60 is displaced to the expanded position and engages the walls 14 of the ore pass 12. The auxiliary gripping member 60 can now be disconnected from the conveyance device 10, and the conveyance device 10 can be removed from the ore pass 12. In this way the auxiliary gripping member 60 will be destroyed upon detonation of the explosive charge, but the bulk of the conveyance device 10 will be preserved. The inventor foresees that the conveyance device may even be used without any explosive charges, in which case it may serve as a scraping device or ramming device suitable for dislodging any type of obstruction from any elongate passageway.

It will be appreciated that the above is only one embodiment of the invention, and that there may be many variations in detail, without departing from the spirit and the scope of the invention. For instance, there may be only one outer and one inner gripping member, with one propulsion member being connected to both in order to facilitate forward movement. Also, any number of gripping and/or propulsion members may be used, depending on the particular application and the amount of thrust required.

The inventor also foresees a number of different uses other than the use in the mining environment as described hereinbefore. For example, the device can be used to travel in any passage, for instance in a building where it may be unsafe for human intervention due to fire, construction or the possible presence of explosives. In this case a camera may for instance be mounted on the device. Also, in a further use the device may be used in environments where inflammable gasses are present, which renders the use of robots or other electrical devices unsafe due to the risk of electrical arcs and/or sparks igniting the gasses.

The invention claimed is:

1. A conveyance device, suitable for traveling along a surface, including:

two outer gripping members and an inner gripping member located between the two outer gripping members, each gripping member being displaceable between a circumferentially expanded position, wherein an outer perimeter of the gripping member is displaced away from a center of the member, so as to, in use, abut at least part of the surface; and a circumferentially contracted position, wherein an outer perimeter of the gripping member is displaced towards the center of the member, so as to be spaced apart from the surface; and propulsion members provided between adjacent gripping members, each propulsion member having two opposite ends, and being displaceable between a longitudinally extended position, wherein the ends are displaced away from one another; and a longitudinally contracted position, wherein the ends are displaced towards one another;

the propulsion members and the gripping members being configured in order for sequential displacement of the propulsion members and gripping members to cause peristaltic displacement of the conveyance device relative to the surface;

the outer gripping members forming a pair of outer gripping members operating in concert so that both outer gripping members are simultaneously in the circumferentially expanded or contracted positions, so that the two outer gripping members are stationary relative to one another when the inner gripping member is displaced between the two outer gripping members.

2. The conveyance device according to claim 1, wherein the ends of the propulsion member are secured to the gripping members.

3. The conveyance device according to claim 1, wherein the outer gripping members are connected to one another by way of an elongate connecting member, and the inner gripping member is slideably located on the elongate connecting member.

4. The conveyance device according to claim 3 wherein the elongate connecting member is in the form of a shaft or rod being substantially circular in cross-section.

5. The conveyance device according to claim 3 wherein the inner gripping member is mounted on a sleeve adapted to slide on the elongate connecting member.

6. The conveyance device according to claim 1, wherein the two propulsion members are configured to operate in an inverse relationship, with one propulsion member being in an extended position when the other is in a contracted position.

7. The conveyance device according to claim 1, wherein at least one gripping member is in the form of a circumferentially displaceable bellows.

8. The conveyance device according to claim 1, wherein at least one gripping member is in the form of a circumferentially expandable air cushion or bladder.

9. The conveyance device according to claim 1, wherein the gripping members are pneumatically operated.

10. The conveyance device according to claim 1, wherein at least one propulsion member is in the form of a longitudinally extendable bellows.

11. The conveyance device according to claim 1, wherein at least one of the propulsion members is in the form of a longitudinally extendable air cushion or bladder.

12. The conveyance device according to claim 1, wherein the propulsion members are pneumatically operated.

13. The conveyance device according to claim 1, including a control system adapted to regulate a pneumatic fluid in order selectively to displace the gripping members and the propulsion members so as to cause peristaltic movement of the conveyance device.

14. The conveyance device according to claim 1, wherein the surface along which the conveyance device is conveyed is an elongate passage.

15. The conveyance device according to claim 14 wherein the passage is in the form of an ore pass.

16. A conveyance device suitable for traveling along a surface, the conveyance device including:

two outer gripping members and an inner gripping member located between the two outer gripping members, each gripping member being displaceable between:

a circumferentially expanded position, wherein an outer perimeter of the gripping member is displaced away from a center of the member, so as to, in use, abut at least part of the surface; and a circumferentially contracted position, wherein an outer perimeter of the gripping member is displaced towards the center of the member, so as to be spaced apart from the surface; and propulsion members provided between adjacent gripping members, each propulsion member having two opposite ends, and being displaceable between:

a longitudinally extended position, wherein the ends are displaced away from one another; and a longitudinally contracted position, wherein the ends are displaced towards one another;

the propulsion members and the gripping members being configured in order for sequential displacement of the propulsion members and gripping members to cause peristaltic displacement of the conveyance device relative to the surface;

the conveyance device characterized therein that the two outer gripping members are stationary relative to one another when the inner gripping member is displaced between the two outer gripping members;

the outer gripping members forming a pair of outer gripping members operating in concert so that both outer gripping members are simultaneously in the circumferentially expanded or contracted positions.

17. A conveyance device suitable for traveling along a surface, including:

a propulsion member having two opposite ends, the propulsion member being displaceable between a longitudinally extended position wherein the ends are displaced away from one another; and a longitudinally contracted position wherein the ends are displaced towards one another;

an outer gripping member and an inner gripping member, each gripping member being displaceable between a circumferentially expanded position wherein an outer perimeter of the gripping member is displaced away from a center of the member so as to, in use, abut at least part of the surface; and a circumferentially contracted position wherein an outer perimeter of the gripping member is displaced towards the center of the member so as to be spaced apart from the surface; and at least one end of the propulsion member abutting at least one of the gripping members, and the propulsion member and the gripping members being configured in order for sequential displacement of the propulsion member and gripping members to cause peristaltic displacement of the conveyance device relative to the surface, and an auxiliary gripping member, the auxiliary gripping member being located outside one of the outer gripping members, and being detachable from the conveyance device so as to selectively remain behind when the conveyance device is removed from the surface on which it is conveyed.

18. The conveyance device according to claim 17 wherein the auxiliary gripping member is adapted to hold an object.

19. The conveyance device according to claim 18 wherein the object is an explosive charge.

20. A method of locating an explosive charge inside an elongate passage, the method including the steps of:

providing a conveyance device suitable for traveling along a surface, the conveyance device including:

two outer gripping members and an inner gripping member located between the two outer gripping members, each gripping member being displaceable between:

a circumferentially expanded position, wherein an outer perimeter of the gripping member is displaced away from a center of the member, so as to, in use, abut at least part of the surface; and a circumferentially contracted position, wherein an outer perimeter of the gripping member is displaced towards the center of the member, so as to be spaced apart from the surface; and propulsion members provided between adjacent gripping members, each propulsion member having two opposite ends, and being displaceable between:

a longitudinally extended position, wherein the ends are displaced away from one another; and a longitudinally contracted position, wherein the ends are displaced towards one another;

the propulsion members and the gripping members being configured in order for sequential displacement of the propulsion members and gripping members to cause peristaltic displacement of the conveyance device relative to the surface;

the conveyance device characterized therein that the two outer gripping members are stationary relative to one another, and the inner gripping member is displaceable between the two outer gripping members;

positioning an explosive charge at an end of the conveyance device; locating the conveyance device inside an ore pass; and causing the conveyance device to advance inside the ore pass in accordance with a method of operating the conveyance device comprising the steps of:

displacing the outer gripping member to the expanded position, while maintaining the inner gripping member and the propulsion member in contracted positions; and displacing the propulsion member to the extended position so as to move the inner gripping member away from the outer gripping member;

the inner gripping member being subsequently displaced to the expanded position, and the outer gripping member to the contracted position, so as to allow the outer gripping member to be displaced towards the inner gripping member when the propulsion member is displaced to the contracted position;

displacing the outer gripping member to the expanded position; and displacing the inner gripping member to the contracted position so as to return the conveyance device to an initial state wherein a next operating cycle can commence.

21. The method according to claim 20 including the steps of:

locating the explosive charge on an auxiliary gripping member located at an end of the conveyance device;

displacing the auxiliary gripping device to an expanded position once a selected location inside the ore pass is reached; and detaching the auxiliary gripping device form the rest of the conveyance device so that the conveyance device can be removed while the auxiliary gripping device, and the charge carried thereby, remain in the ore pass.

* * * * *